US007130247B2

(12) United States Patent
Brida et al.

(10) Patent No.: US 7,130,247 B2
(45) Date of Patent: Oct. 31, 2006

(54) WATCH WITH FLY BACK HAND FUNCTION AND CORRESPONDING FLY BACK HAND MECHANISM

(75) Inventors: Pius Brida, Neuhausen am Rheinfall (CH); Denis Zimmermann, Kleinandelfingen (CH); Stefan Ihnen, Schaffhausen (CH)

(73) Assignee: Richemont International SA, Villars-sur-Glane (CH)

( * ) Notice: Subject to any disclaimer, the term of this patent is extended or adjusted under 35 U.S.C. 154(b) by 318 days.

(21) Appl. No.: 10/873,143

(22) Filed: Jun. 23, 2004

(65) Prior Publication Data

US 2004/0264303 A1 Dec. 30, 2004

(30) Foreign Application Priority Data

Jun. 26, 2003 (EP) ..... 03014339

(51) Int. Cl.
*G04F 10/00* (2006.01)

(52) U.S. Cl. ..... 368/110; 368/112

(58) Field of Classification Search ..... 368/110, 368/112, 113

See application file for complete search history.

(56) References Cited

U.S. PATENT DOCUMENTS 1,790,359 A * 1/1931 Weir ..... 368/101
3,747,324 A * 7/1973 Foufounis ..... 368/228
4,012,900 A * 3/1977 Enright ..... 368/97
5,255,248 A * 10/1993 Goodmon ..... 368/228

FOREIGN PATENT DOCUMENTS

EP 0 562 155 9/1993

* cited by examiner

*Primary Examiner*—Kamand Cuneo
*Assistant Examiner*—Thanh S. Phan
(74) *Attorney, Agent, or Firm*—Young & Thompson

(57) ABSTRACT

A watch with an analog time display has at least one minute hand and one hour hand. This watch is moreover equipped with a fly back hand mechanism which has at least one minute fly back hand and/or hour fly back hand located coaxially to the hands of the normal time display. In the normal mode, the fly back hand or hands is/are moved synchronously with the hands of the normal time display and relative to them in an overlapping position. They can be stopped in a timer mode for marking of any instant of time and after expiry of any time interval, for again synchronously running with the hands of the normal time display. The actuated coupling of the fly back hand mechanism is located preferably non-coaxially to the axis of the motion work of the watch.

15 Claims, 8 Drawing Sheets

WATCH WITH FLY BACK HAND FUNCTION AND CORRESPONDING FLY BACK HAND MECHANISM

FIELD OF THE INVENTION

This invention relates to a watch, especially a wristwatch, with an analog time display which has at least one minute hand and one hour hand, and with a fly back hand mechanism which has at least one minute fly back hand and/or hour fly back hand located coaxially to the hands of the normal time display.

Such a watch will enable both normal time indication as well as measurement of time differences or reading of the durations of various events in a simple and effective manner.

BACKGROUND OF THE INVENTION

The prior art in this respect includes especially chronographs which have a fly back hand function. In this case the fly back hand mechanism is generally used to temporarily stop the timer hand during the timing process, while the measurement process continues in order to allow it to then jump to the measured total time. This is for example the case in order to allow reliable reading of intermediate times while the measurement of the end time continues for the time being. Usually either the normal time display is omitted in these watches, the watch thus being purely a timer, or the timing function is implemented in a separate auxiliary display. Thus, in many applications, the desired information must first be laboriously computed from the information of the normal time display and the measurement of the auxiliary display, and it is usually not possible to directly read the absolute time of the start or end of an event.

Therefore there are also watches with normal analog time indication, which have additional hands which can be moved to a desired position at a certain instant and then directly indicate the relationship and the time difference from the current time.

The document U.S. Pat. No. 1,790,359 describes for example a device by means of which a watch with conventional time indication by means of minute and hour hands can be equipped with additional minute and hour hands in order to indicate the time difference between the instant of the start of an event and the current time. The additional minute and hour hands are manually set in this case, therefore the position of the additional minute and hour hands is always stationary as long as they are not manually moved. The use of such a manual device is obviously tedious, time-consuming and disruptive in normal reading of the time.

U.S. Pat. No. 5,255,248 describes a watch with the same purpose, i.e. a watch which simultaneously allows both normal time indication and also the measurement of a time difference, which is therefore neither a timer nor a completely normal watch, but integrates the two functions in one display. The means which are used for this purpose and primarily the manner of operation are different here.

The watch which is proposed in this patent on the one hand has one additional minute hand which is located coaxially to the hands of the normal time display and which can be moved out of a stationary normal position into the current position of the normal minute hand by actuating a pushbutton. There it remains stationary again in order to mark the start of an event. The step of setting of the additional hand to the current time can be carried out according to the document by means of a conventional fly back hand mechanism.

On the other hand, the described watch has a ring with a marking and a scale which can be turned coaxially around the dial in order to mark for example the end of the event and thus to integrate a "count-down" function.

While this watch thus simultaneously allows normal time indication and also the measurement of the time difference, a fly back hand mechanism for moving the additional minute hand being proposed, the reading of the corresponding displays is not optimum to the extent that the additional minute hand as mentioned has only stationary positions and therefore quite adversely affects the reading process of normal time indication when its time measurement and marking function is not being used. Namely, this hand remains in the position in which it was used last and therefore is continually visible on the dial as a disruptive element.

SUMMARY OF THE INVENTION

The objective of this invention is to make a watch both for normal time indication as well as for effective and simple measurement of time differences respectively for reading the durations of various events while avoiding the aforementioned disadvantages of the current systems, and the implementation of a fly back hand mechanism which is suitable for this purpose.

The subject matter of this invention is therefore a watch, especially a wrist watch, which has the characteristics of claim 1 and a fly back hand mechanism which is suitable for implementation of this watch with the characteristics named in the claims.

A watch according to the invention is characterized especially in that the fly back hand or hands which are also called split hands is/are moved, in the normal mode of the watch, synchronously with the hands of the normal time display and relative to them in an overlapping position, and that they can be stopped in a timer mode for marking of any instant as well as that they can be moved, after lapse of any time interval, for again synchronously running with the hands of the normal time display, again into the overlapping position relative to them.

This means that this approach makes it possible to arrange the additional hand or hands in the normal mode of the watch for example under the hands of the normal time display, therefore not visible from the top, and to allow them to execute synchronous concomitant motion, while in the aforementioned known watches the additional hand or hands in contrast thereto remain in the normal mode at a stationary position.

In the watch proposed here, the additional hand or hands are set by the fly back hand mechanism out of their stop position back again into their (not stationary) normal position in an overlapping position relative to the hands of the normal time display. In contrast, the fly back hand mechanism in the aforementioned document U.S. Pat. No. 5,255,248 is used so-to-speak in a reverse manner insofar as the additional minute hand is moved out of its (stationary) normal position into its stop position by means of the fly back hand mechanism.

In a watch according to the invention, the initiation of the stopping and set-back process of the additional hands can take place via a control element such as a pushbutton or a rocking commutator.

Moreover, there can be a status display, whether by the aforementioned commutator, an explicit display window or the like in order to indicate to the user the current operating mode.

Likewise it is possible to provide such a watch with an internal or external ring which is equipped with a scale in order to indicate for example the desired total duration of an event.

BRIEF DESCRIPTION OF THE DRAWINGS

Other advantages arise from the features named in the dependent claims and the description which details in the following the invention with the help of figures.

The attached figures schematically and by way of example represent several embodiments of a watch according to the present invention.

DETAILED DESCRIPTION OF THE INVENTION

Figure 1A:
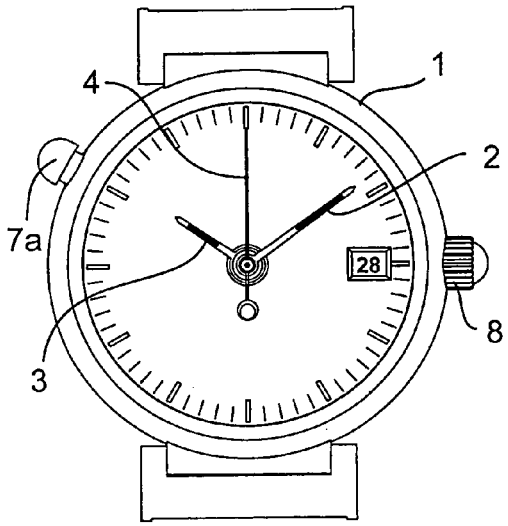
FIGS. 1*a* to 1*d* schematically illustrate the principle and operating sequence of a first embodiment of such a watch.

The invention will be detailed below using the aforementioned figures.

As FIG. 1 clearly shows, the present invention concerns a watch 1, especially a wristwatch, with analog time indication, which has at least one minute hand 2 and one hour hand 3. Moreover, it can have a second hand 4.

Furthermore it should be stressed that this watch has a minute and hour fly back hand mechanism or only a minute fly back hand mechanism respectively only an hour fly back hand mechanism, depending on the intended use of the watch which can relate to different orders of magnitude of the time intervals to be measured and therefore may influence the aforementioned choice.

The fly back hand mechanism has at least one fly back hand which is located coaxially to the hands 2, 3 of the normal time display, generally a minute fly back hand 5 or an hour fly back hand 6, but can also have several fly back hands, for example besides the minute fly back hand 5 an hour fly back hand 6 which is likewise arranged coaxially, or even a second fly back hand.

In contrast to most known cases in which conventionally the fly back hand mechanism is integrated into chronographs, this mechanism is inserted into a normal watch, for example an wrist watch so that normal time display and measurement of the time difference using the fly back hand mechanism can take place at the same time in a single display.

Technically the minute or hour fly back hand mechanism could be identical to known versions of a fly back hand mechanism for chronograph split hands. Such a fly back hand mechanism is detailed for example in patent application EP 0 562 156 so that a description in this respect need not be repeated here.

In the case of a minute and hour fly back hand mechanism or a mechanism which even takes into account seconds, generally in the case of more than one fly back hand, the mechanism is advantageously implemented by one of the embodiments of this mechanism which are detailed below, since they both reduce the height of the movement and thus the height of the watch as well as improve the accessibility of the individual components of the fly back hand mechanism, for example in the case of maintenance or repair.

The aforementioned advantages arise especially when using a mechanism with more than one fly back hand, however, for a more understandable description and due to the fact that the fly back hand mechanism according to the present invention can also be used in the case of a single fly back hand and in applications other than the present watch, for example also other types of watches such as in a chronograph, the mechanism according to the invention will be described first of all for the case of a minute fly back hand, then for that of an hour fly back hand and finally for the example of a minute and hour fly back hand.

The manner of operation of a (minute) fly back hand mechanism according to the invention is generally similar to that of known fly back hand mechanisms. But the present mechanism is characterized by a different composition and arrangement of parts or assemblies of the mechanism. The actuated coupling of a fly back hand mechanism according to the invention is not located in the center of the motion work, as in known fly back hand mechanisms, but outside next to the motion work. As a result of this structure, as the following explanations will elucidate, the overall height of the movement is reduced and the access to the components is facilitated by an increased modularity.

The minute fly back hand mechanism consists mainly of three assemblies, specifically a blocking device 20 (FIG. 5) with a slider 21, a spring 22 and a clam 23, a reset device 30 together with a heart wheel 31 (FIG. 8*a*) and a reset lever wheel 33 (FIG. 8*b*) with coupling and a motion work 50 (FIGS. 5, 9*a*, 9*b* and 12) which accommodates parts respectively the corresponding wheels of the mechanism.

Figure 5:
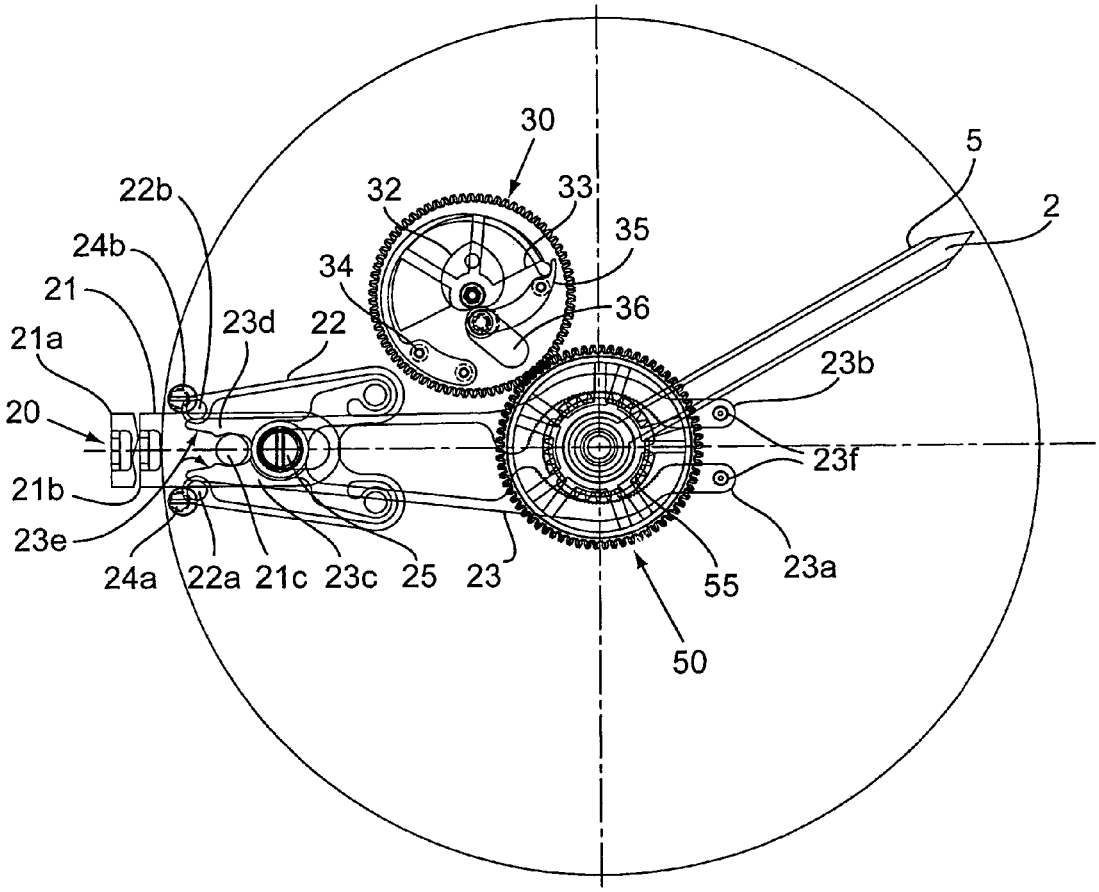
FIG. 5 shows an overhead view of a minute fly back hand mechanism according to the invention.
Figure 6A:
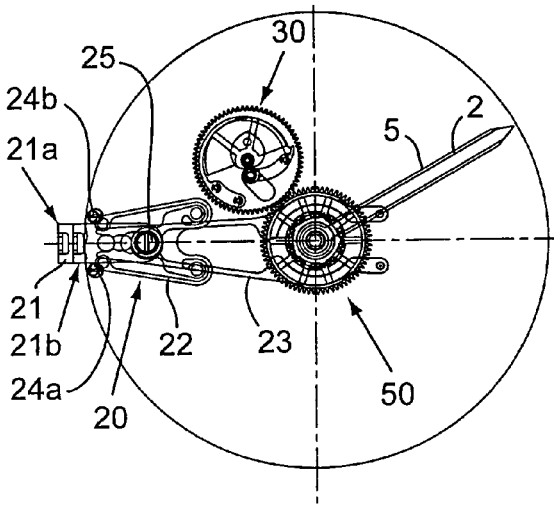
FIGS. 6*a* and 6*b* show overhead views of the minute fly back hand mechanism of FIG. 5 with the clam open, therefore in the operating mode for concomitant movement of the split minute hand, this with respectively without representation of the cannon pinion and the corresponding minute hand.
Figure 7A:
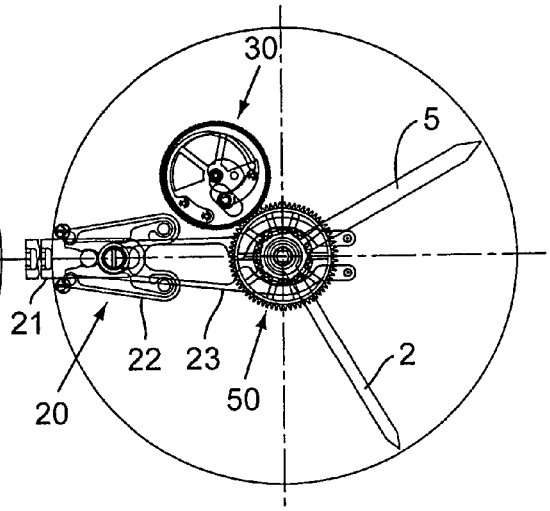
FIGS. 7*a* and 7*b* show overhead views of the minute fly back hand mechanism of FIG. 5 with the clam closed, therefore in the operating mode for stopping the split minute hand, this in turn with respectively without representation of the cannon pinion and the corresponding minute hand.
Figure 6B:
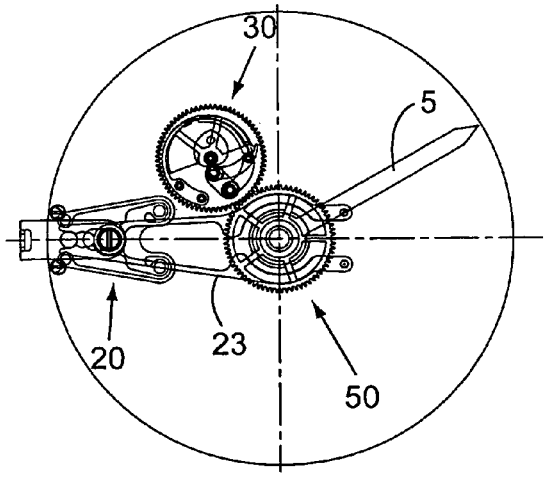
Figure 7B:
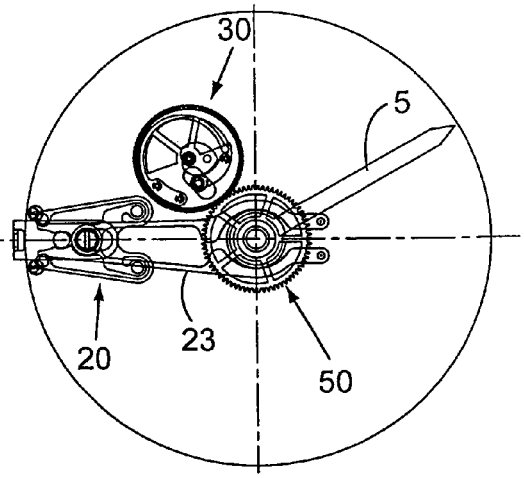

As is apparent from FIG. 5, for a more detailed explanation of the blocking device 20, control of the clam 23 which encompasses the stop wheel 55 on the motion work 50 and its longer clam ends 23*a* and 23*b* takes place by means of a slide 21 which cooperates with the control element 7 on the case. The slide 21 is doubly guided by means of an elongated recess and a sleeve 26, on the one hand, and on the other two adjustable eccentrics 24*a,b* or as an alternative two fixed pins which are mounted on the bottom plate 15 to the left and right of the slide 21. The control element 7 on the case can move the slide 21 in a straight line into one of two positions 21*a,b*, a tensioned position 21*a* with open clam ends 23*a,b* (see FIGS. 6*a* and 6*b*) and a compressed position 21*b* with closed clam ends 23*a,b* (see FIGS. 7*a* and 7*b*). By moving the slide 21 (FIG. 6*a* and 7*a*) the opening and closing of the clam 23 takes place by a pin 21*c* which is mounted on the end of the slide 21 pointed into the interior of the case sliding along the tapering lateral internal surfaces 23*e* of the shorter ends 23*c* and 23*d* of the clam 23. The curved shape of the tapering lateral internal surfaces 23*a* of the shorter clam ends 23*c* and 23*d* forms a kind of cam which produces a pressure point in order to prevent uncontrolled movement of the pin 21*c* by external impacts. So that contact with the lateral internal surfaces 23*e* can take place over the entire length, a spring 22 is placed by means of the screw 25 and/or other fastening element such that its ends pointing to the outside and having pins 22*a,b* press on the external sides of the shorter clam ends 23*c* and 23*d* and thus exert a force for opening the longer ends 23*a,b* of the clam 23. The spring 22 moreover limits the vertical play of the slide 21 in the area of the screw 25 (see FIG. 9*b*). By means of the two eccentrics 24*a,b* not only is the guide play of the slide 21 adjustable, but the position and the concentricity of the teeth of the longer ends 23*a* and 23*b* of the clam 23 can be adjusted relative to the stop wheel 55 in the center of the motion work insofar as the entire blocking device 20 with the slide 21, spring 22 and clam 23 can turn radially around the sleeve 26.

Thus, in the compressed position 21*b* of the slide 21 by closing the clam 23 the stop wheel 55 is blocked against its turning while it can turn freely in the tensioned position 21*a* of the slide 21.

In addition to other simpler alternatives to this blocking device, a slide which is configured somewhat differently would be conceivable; on its end which points into the interior of the case it has teeth and with them, in its compressed position, therefore simply after longitudinal displacement, positively blocks the stop wheel 55, acting on its edge, against torsion of it.

As follows from FIGS. 8*a* to 8*d* and FIG. 9*a*, the actuated coupling which is located non-coaxially to the axis 58 of the motion work 50 consists of a reset device 30. It has two subassemblies and cooperates, as will be explained below, with another subassembly which is suitable for this purpose respectively corresponding parts of the fly back hand mechanism which are located in the motion work 50.

The first subassembly of the reset device 30 has a heart wheel 31 with a heart 32 which is mounted on it, the second subassembly has a reset lever wheel 33 with a lever spring 34, a lever 35 and a roller 36 (version 1) or a sliding block 37 (version 2). In practice, for the reset device assembly rather the version with the sliding block 37 according to FIG. 8*d* is preferred because the flat surface of the sliding block 37 can rest completely on the "heart valves" or shoulders of the heart 32; this is equivalent to a 2-point rest. The latter is more stable than a 1 point-rest in the case of the roller 36 in the version according to FIG. 8*c*. Instead of the heart 32 of the first subassembly a worm-shaped eccentric could also be used. However, this causes one disadvantage in the hand setting by the winding stem and the crown which can take place in this case only in one direction of rotation.

Figure 9A:
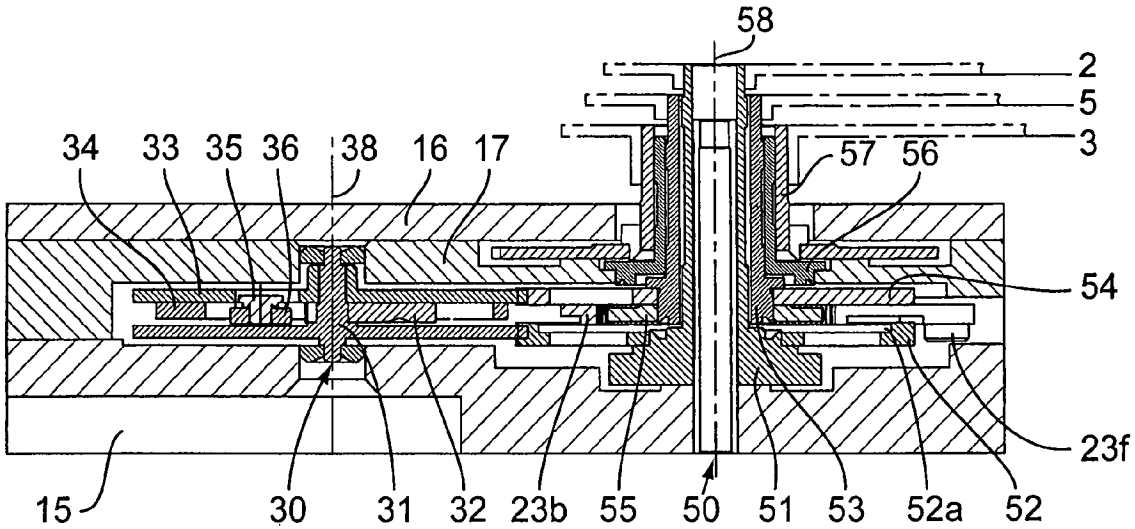
FIGS. 9*a* and 9*b* are sections through the mechanism of FIG. 5, on the one hand showing the reset device and the motion work, on the other the blocking device, the minute wheel and the motion work.

The motion work 50 in the center of the watch movement corresponds in its basic structure roughly to the structure of a classical universal time clock, as shown in FIG. 9*a*, but accommodates additional parts which belong to the fly back hand mechanism.

The lowermost plane has a cannon pinion 51 with a cannon pinion wheel 52 which is mounted on it, the cannon pinion 51 bearing the minute hand 2. The center plane accommodates the parts of the fly back hand mechanism which interact with the actuated coupling and which bear the fly back hand or hands 5, 6. These are a split minute hand pipe 53 which bears the split minute hand 5 and a split minute hand wheel 54 which is also called indication wheel, on the latter a stop wheel 55 being attached such that it is located at the height of the aforementioned clam 23, insofar as the clam 23 encompasses as mentioned the stop wheel 55 on two sides. The uppermost plane has an hour pipe 56 which is riveted for example on the bridge 17 which lies for example underneath the upper bridge 16, and serves the hour wheel 57 as an axis of rotation, the hour wheel 57 bearing the hour hand 3 on its tubular part.

Figure 9B:
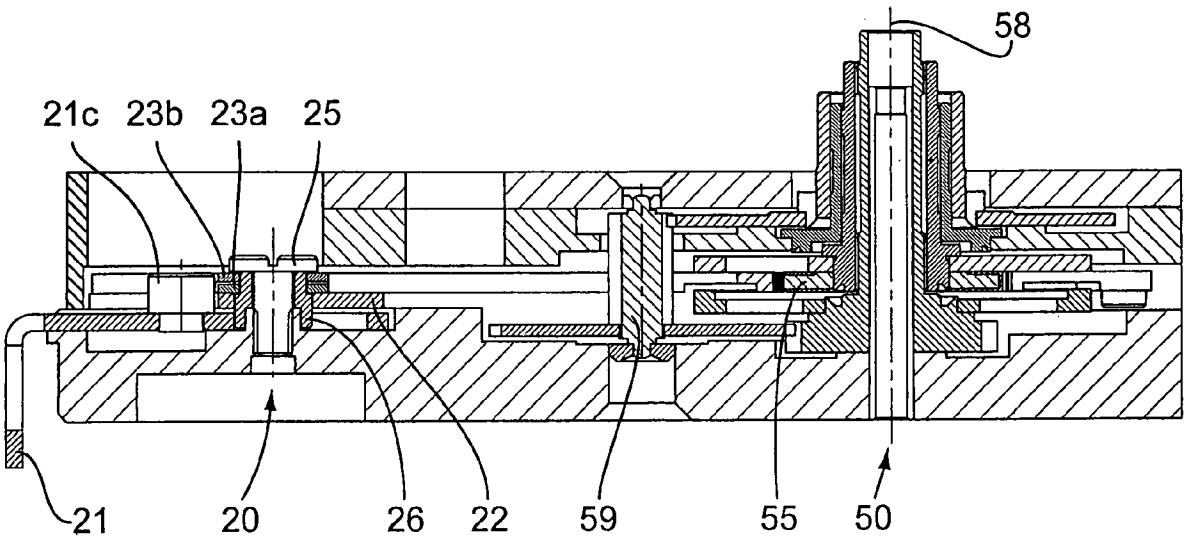

Reference is made to FIGS. 9*a* and 9*b* which clearly show the individual components' interfitting for explanation of the manner of operation of the minute reset device 30 in interplay with the motion work and the blocking device.

The clam 23 respectively its longer ends 23*a* and 23*b* were mounted vertically such that they span the stop wheel 55 on two sides and keep poised the split minute hand wheel 54 which is connected to it and which has a greater diameter. The split minute hand wheel 54 thus rests on the longer clam ends 23*a* and 23*b* without touching on the upper side the hour pipe 56 on its lower part which is affixed to the bridge 17 and without being supported on the lower side on the top of the cannon pinion 51. In this way the cannon pinion 51 can turn freely and the daily running of the watch is not adversely affected by additional friction on the other parts. In case of an axial impact upwards the split minute hand wheel 54 strikes the hour pipe 56, for an axial impact downwards the two pins 23*f* on the longer clam ends 23*a* and 23*b* can be supported by the bottom plate 15. Insofar as the clam ends 23*a* and 23*b* have been shaped as springs, they press, after a possible impact, the split minute hand wheel 54 back again into the initial position. For a radial impact the clam ends 23*a* and 23*b* yield, in the extreme case they strike at the height of the teeth the inside wall 52*a* of the cannon pinion wheel 52 which is provided with a recess on its top and are thus stopped. In this case, the above described spring 22 presses the clam 23 by means of the pins 22*a* and 22*b* which engage the shorter clam ends 23*c* and 23*d* back into the initial position. The hour wheel 57 rests on the bridge 17 and thus has no effect on the lower wheels in the motion work. The hour wheel is driven in the conventional manner via the minute wheel 59, as shown in FIG. 9*b*.

Figure 8A:
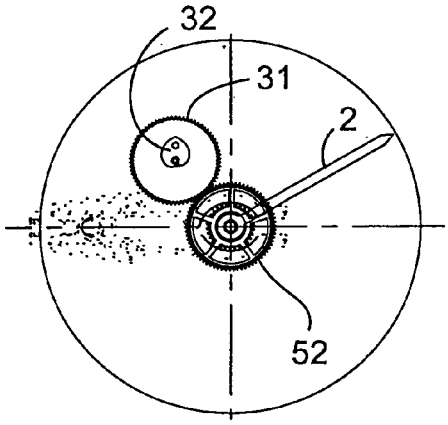
FIGS. 8*a* and 8*b* represent the cooperation of the heart wheel respectively of the reset lever wheel of the reset device with the motion work.
Figure 8B:
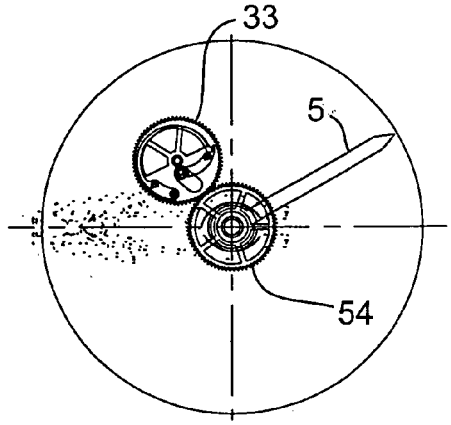
Figure 8C:
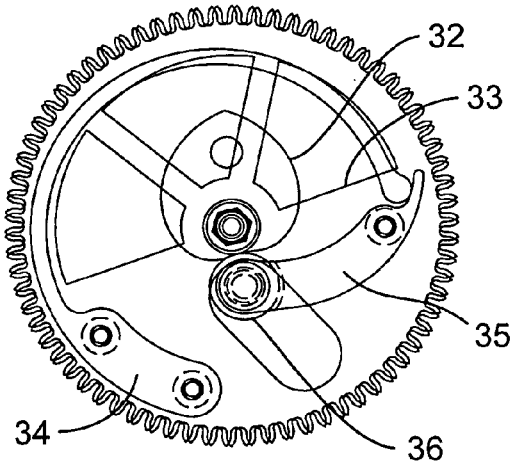
FIG. 8*c* represents the extreme relative positions of the components of the actuated coupling of the reset device and FIG. 8*d* shows one version of this coupling.
Figure 8C:
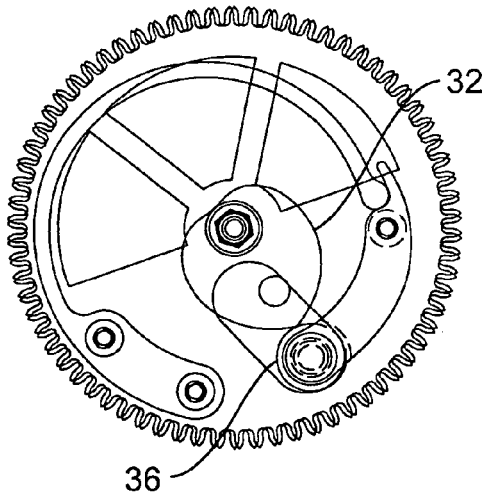
Figure 8D:
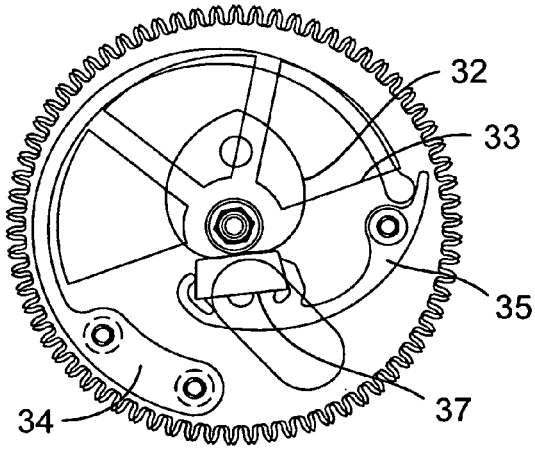

In order to arrive at the actual manner of operation of the fly back hand mechanism, it is apparent from FIG. 9*a* and FIGS. 8*a* and 8*b* that on the one hand the heart wheel 31 fits into the cannon pinion wheel 52 and on the other hand the reset lever wheel 33 fits into the split minute hand wheel 54. This is possible due to the non-coaxial arrangement of the reset device 30 relative to the motion work 50 in which the axes 38 of rotation of the reset device and 58 of the motion work are not identical. If, as described above and as is apparent from FIGS. 6 and 7, the stop wheel 55 after actuating the control element 7 is blocked by the clam 23, the split minute hand wheel 54 which is tightly connected to the stop wheel 55 and the reset lever wheel 33 which is engaged to the split minute hand wheel are blocked against torsion so that the split minute hand 5 is stopped. Conversely, see FIG. 9*b*, the cannon pinion wheel 52 and the hour wheel 57 continue to be driven by the minute wheel 59 so that the minute and hour hands 2, 3 of the normal time display continue to turn normally. In this way relative torsion between the heart wheel 31 and the blocked reset lever wheel 33 is produced so that, as explained in FIGS. 8*c* and 8*d*, the side surface of the heart 32 during its rotation acts against the reset force of the lever spring 34 on the roller 36 or on the sliding block 37 which is attached to the lever 35. When blocking of the stop wheel 55 is cancelled by reactuation of the control element 7 the roller 36 or the sliding block 37 as a result of the reset force of the lever spring 34 and the corresponding configuration of the side surfaces of the heart 32 slides along them into the rest position which is opposite the tip of the heart 32 and in this way moves the split minute hand 5 back into the overlapped position relative to the minute hand 2.

The hour fly back hand mechanism works in an analogous manner as the above described minute fly back hand mechanism. The differences in structure are apparent from FIGS. 10 and 11 respectively 9 and 12.

The blocking device 20 remains unchanged. As the non-coaxial arrangement of the reset device 30/40 relative to the motion work 50/60 allows this without difficulty, the reset device 40 for the split hour hand 6 which has the same structure relative to what was described above was attached compared to the above described reset device for the split minute hand 5, for reasons which will be apparent later, on the opposite side of the motion work 60, as follows from FIGS. 10 and 11.

Figure 12:
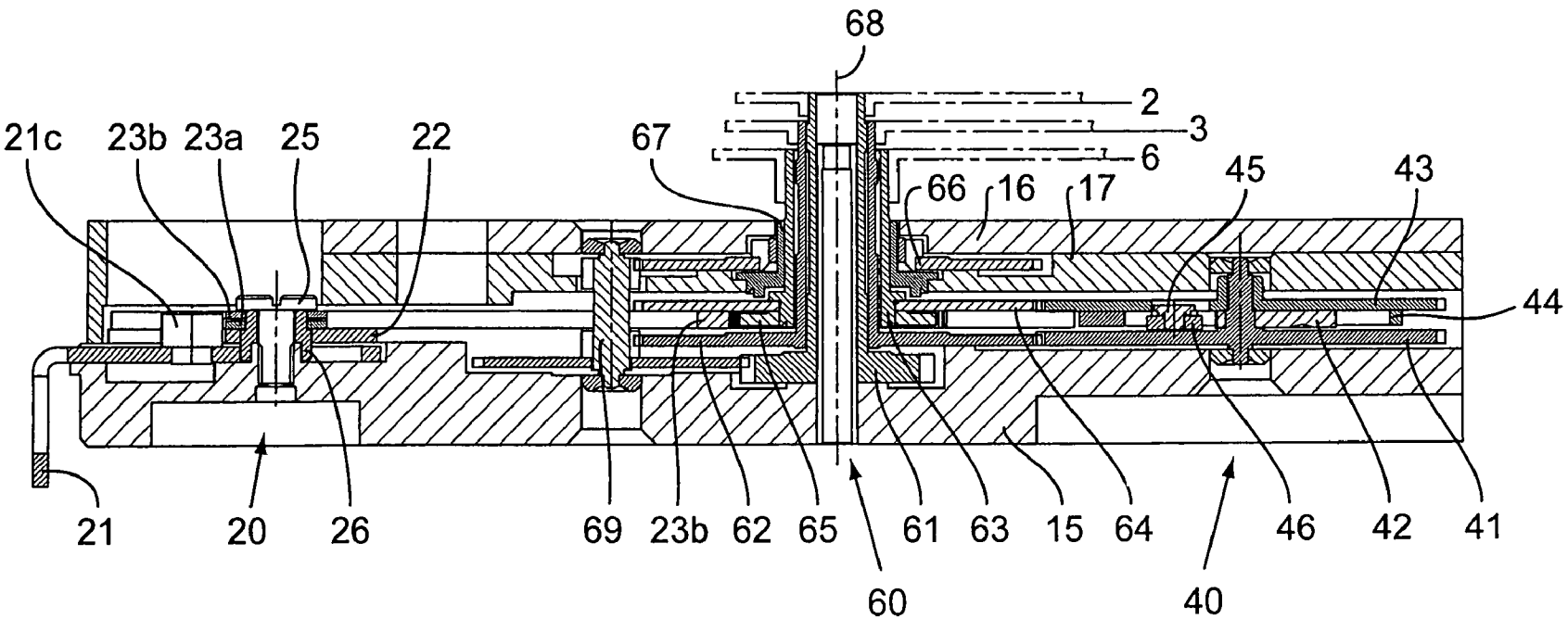
FIG. 12 shows a section through the mechanism of FIG. 10, showing the blocking device, the minute wheel, the motion work and the reset device.

In the section of FIG. 12, the structure of the motion work 60 in the center of the watch for the case of the hour fly back hand mechanism is shown. Here the wheels are also separated from one another by a safety interval so that the torques, for example those of the split hour hand wheel 64 or of the date setting wheel 66 have no effect on the adjacent wheels. In this way the individual functions of the watch are not disrupted by uncontrollable friction effects with other parts.

In turn the motion work 60 can be explained in planes. On the lowermost planes is the cannon pinion 61 which as in the previous case bears the minute hand 2 and is driven by the minute wheel 69. The latter likewise drives the hour wheel 62 which has been placed on the middle plane and which bears the hour hand 3. Free rotation of the hour wheel 62 via the cannon pinion 61 which does not have a cannon pinion wheel here is ensured by the fact that the split hour hand wheel 64 which is located in the overlying plane rests on the clam 23. This split hour hand wheel 64 is mounted on the split hour hand pipe 63 which bears the split hour hand 6 and thus turns with little play concentrically in the hole of the pipe 67 which is riveted on the bridge 17. The vertical play of the split hour hand wheel 64 is limited to the bottom by the two longer clam ends 23*a* and 23*b* and to the top by the lower part of the pipe 67 which is riveted in the bridge 17, as is apparent from FIG. 12. The date setting wheel 66 which is located in the upper plane and which is likewise driven via the minute wheel 69 belongs to the date mechanism. This was shown in FIG. 12 to illustrate its separation from the split hour hand wheel 64. The date setting wheel 66 lies on the bridge 17 and turns concentrically with slight play around the tightly riveted pipe 67. By means of this structure the variable torques of the date mechanism have no effect at all on the split hour hand wheel 64 which is located farther underneath.

As in the above described case, the motion work is staggered around a central bearing pipe which is attached coaxially to the axles 58 respectively 68 and all wheels outside the motion work 50/60 respectively outside the center of the watch are advantageously supported on bearing blocks, as is indicated in the drawings.

Figure 10:
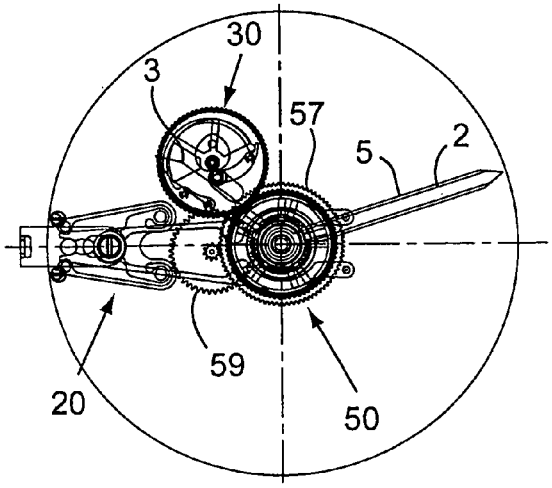
FIG. 10 shows an overhead view of a minute fly back hand mechanism according to the invention together with the corresponding hands.
Figure 11:
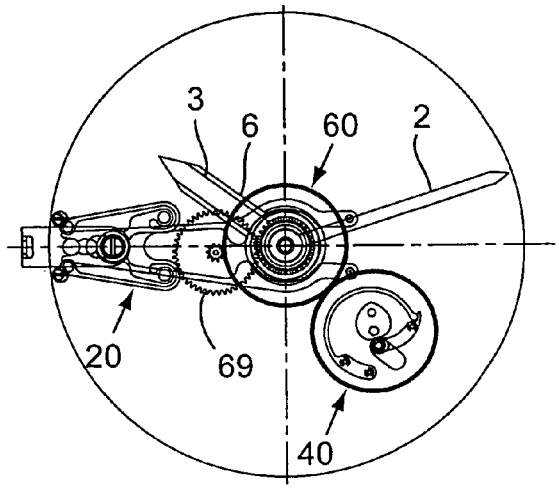
FIG. 11 shows an overhead view of an hour fly back hand mechanism according to the invention together with the corresponding hands.

The manner of operation of the minute fly back hand mechanism and of the hour fly back hand mechanism are analogous, as is apparent from FIGS. 10 and 11 respectively 9*a,b* and 12. In the latter case the heart wheel 41 is engaged to the hour wheel 62 and the reset lever wheel 43 to the split hour hand wheel 64 in order to move the split hour hand 6 in the overlapping position relative to the hour hand 3 or to stop it. The remaining sequence is completely analogous to what was described above.

Figure 13A:
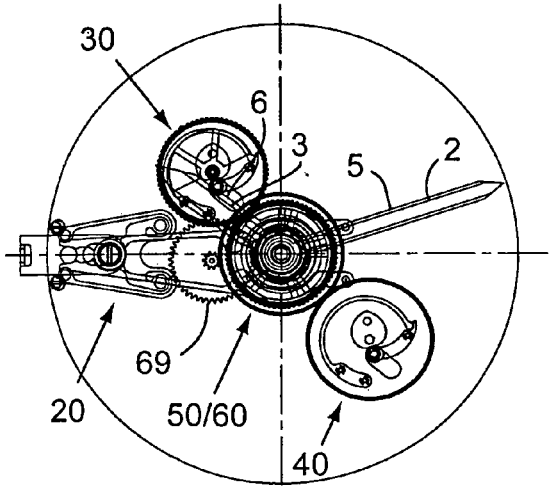
FIGS. 13*a* and 13*b* show overhead views of two embodiments of a minute and hour fly back hand mechanism according to the invention together with the corresponding hands.
Figure 13B:
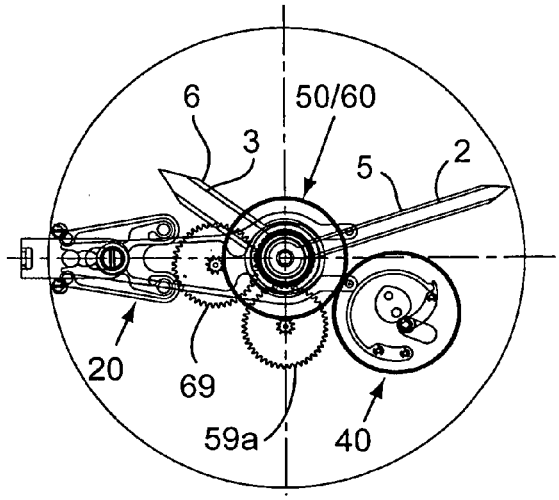

The advantages of the fly back hand mechanism described above using two examples now become clear especially in the implementation of a minute and hour fly back hand mechanism. This one can be implemented in two different ways, which are shown in FIGS. 13*a* and 13*b*. Sections through this mechanism are not shown due to the analogy to the already described mechanisms. Such a mechanism allows at first the implementation of a watch with a fly back hand function according to the present invention in the desired simplicity in spite of the diversity of functions.

The minute and hour fly back hand mechanism as shown in FIG. 13*a* is formed by the combination of the minute fly back hand mechanism as shown in FIG. 10 with the hour fly back hand mechanism as shown in FIG. 11. Based on the advantageous arrangement of the reset devices on radially opposite sides of the motion work, this combination of the two above described fly back hand mechanisms according to the invention for the minutes and for the hours is an easy undertaking. At the same time this constellation illustrates the advantages of a mechanism according to the invention since here the saving of movement height is very apparent. Moreover the modularity of the mechanism becomes clear, which due to the individual accessibility of the individual separate assemblies enables their separate maintenance or repair.

In order to ensure the separation of the two split hand wheels for the minutes 54 and for the hours 64, another bridge around the combined motion work 50/60 should be installed in this case. The sequence of the wheels respectively of the planes described above in the motion work can be changed anyway, for example to reverse the sequence of the normal hand and the corresponding split hand; this is familiar to one skilled in the art. The gradation in the section, from bottom to top, can appear in detail for example as follows: in the first plane is the cannon pinion 51 with the cannon pinion wheel 52, in the second plane is the split minute hand pipe 53 with the split minute hand wheel 54 and the stop wheel 55, in the third plane is the newly inserted bridge and the hour wheel 62, in the fourth plane is the split hour hand pipe 63 with the split hour hand wheel 64 and the corresponding stop wheel 65, and in the fifth plane is the bridge 17, the date setting wheel 66 and the bridge 16. Other versions are of course also conceivable. The clam 23 is made and placed here such that it acts simultaneously on the corresponding planes on the two stop wheels 55 and 65. The two reset devices 30 and 40 engage as described above the corresponding wheels of the motion work 50/60 and are therefore located at a corresponding height at their radial position around the motion work.

The manner of operation of this minute and hour fly back hand mechanism in this version is fully analogous to what was explained above so that in this case both the minute hand 2 and also the hour hand 3 have a corresponding split hand 5 respectively 6 which are either moved concomitantly in the overlapping position relative to the hands of the normal time display or stopped.

In this version the height of the movement is somewhat greater than in the case of only one fly back hand function, but this is compensated by the non-coaxial arrangement (as shown in FIG. 13*a*) of the reset devices 30 and 40 which would otherwise be located in the motion work and which would make the height of the movement correspondingly greater; this indicates in a particularly clear manner the advantage of the mechanism according to the invention. As mentioned, in this way moreover the individual assemblies are accessible extremely easily due to their radial arrangement around the motion work and thus can be handled separately in the case of maintenance or repair.

FIG. 13*b* shows one version of the minute and hour fly back hand mechanism in which the reset device 40 for the hours simultaneously controls both the split hour hand wheel 64 and also via the minute wheel 59*a* the split minute hand wheel 54. This minute wheel 59*a*, like the reset device for the hours, advantageously assumes a position radially outside of motion work which is located in the center of the watch and functions with respect to the flow of forces in the reverse manner compared to the traditional minute wheel 59. The reset device 40 for the hours controls first of all, as described above, the split hour hand wheel 64 and the latter is engaged to the pinion of the minute wheel 59*a* for the split minute hand 5. The wheel of this minute wheel 59*a* is engaged to the split minute hand wheel 54 and due to the resulting transmission of the number of revolutions causes synchronous motion of the split minute hand 5 and the split hour hand 6 or the simultaneous stopping of these split hands.

The advantage of this version lies in the saving of an entire reset device. However an additional minute wheel 59*a* which replaces this device is required and a relative large amount of rotary play of the split minute hand 5 is caused by the sum of the corresponding amounts of play of the teeth in the motion work.

With respect to the number of revolutions, the transmission ratios in the mechanism according to the invention compared to a traditional motion work do not change. As an example, first the motion work of FIGS. 9*a,b* is detailed, the number of teeth agreeing with the representations of the wheels:

Cannon pinion Z1=30 teeth

Minute wheel Z2=45 teeth (wheel), Z3=10 blades (hour pinion)

Hour wheel Z4=80 teeth

It follows for the hour display that for one revolution of the minute display it executes 1×30/45×10/80=1/12 revolution, as expected.

The computation for the watch movement, especially with respect to the hour fly back hand mechanism as shown in FIG. 13*a*, reads as follows:

Cannon pinion Z1=80 teeth

Reset device Z6=Z6'=70 teeth (2 wheels on top of one another)

Minute wheel Z5=14 teeth (hour pinion)

Hour wheel Z4'=72 teeth

For the hour display follows in turn 1×30/70×14/72=1/12 revolution for one revolution of the minute display.

Finally, for the version of the mechanism as shown in FIG. 13*b* the computation is done as follows:

| | |
|---|---|
| Cannon pinion | Z1 = 30 teeth |
| Minute wheel (for hours) | Z2 = 45 teeth (wheel), |
| | Z3 = 10 blades (pinion) |
| Hour wheel | Z4 = 80 teeth |
| Heart wheel | Z6'' = 80 teeth |
| Reset lever wheel | Z6''' = 80 teeth |
| Split hour hand wheel | Z4'' = 80 teeth |
| Minute wheel (for minutes) | Z2' = 45 teeth (wheel), |
| | Z3' = 10 blades (pinion) |
| Split minute hand wheel | Z1' = 30 teeth |

It follows for the split minute hand display that it executes 1×30/45×10/80×80/80×80/10×45/30=1 revolution for one revolution of the minute display, likewise as expected.

It becomes clear from the aforementioned that the operating principle of a fly back hand mechanism according to the invention is generally similar to that of the known fly back hand mechanisms. However, this mechanism has several advantages compared to the prior art due to the different composition and arrangement of the parts respectively assemblies of the mechanism, especially by the actuated coupling outside of instead of coaxially to the motion work. Based on this structure, on the one hand the overall movement height, especially in case of simultaneous integration of a minute and hour fly back hand mechanism, is reduced. Fundamentally, by the reset devices or minute wheels which are radially positioned around the central motion work, an additional split second hand is also conceivable by analogy to the description above. On the other hand, the modularity of the mechanism is enhanced, facilitating access to the components for maintenance or repair.

The integration of such a mechanism into a watch with analog time indication makes it possible that the split hand or hands 5, 6 may be moved synchronously with the hands 2, 3 of the normal time indication and in overlapping position relative to them in a normal mode of the watch, and that they may be stopped in the timer mode for marking some instant in time, as well as that they may be, after expiry of any time interval, for again synchronous running with the hands of the normal time display, moved again into the overlapping position relative to the latter.

The watch 1 for control of the fly back hand mechanism respectively of the corresponding fly back hands 5, 6 has a control element 7, for example a push-piece 7*a* which is located independently of the crown 8 of the watch on the edge of the case of the watch. The operation of the fly back hand mechanism by the corresponding control element 7 respectively the cooperation of these two components takes place in a conventional manner. Initial actuation of the control element 7 causes stopping of the minute and/or hour fly back hands 5, 6 at their current position, further actuation of the control element 7 which is possible at any time moves the hand/hands 5,6 back into congruence with the minute and/or hour hand 2,3 of the normal time display for again synchronous running with them.

As follows from the attached FIGS. 1*a* to 1*d*, the operating sequence for measuring time differences or reading the durations of various events by means of the watch 1 which in this example has a minute and hour fly back hand mechanism is the following:

As shown in FIG. 1*a*, during normal operation of the watch 1 the minute and hour fly back hands 5, 6 are preferably, not visible from overhead, under the minute and hour hands 2, 3 of the analog time display, which are symbolically identified with a rectangle, and turn synchronously with them. Of course the minute and hour fly back hands 5, 6 can also be mounted over the minute and hour hands 2, 3 of the analog time display, insofar as it is primarily the overlapping relative position of the hands 2, 3 and 5, 6 and their synchronous movement which are important. In the normal mode of the watch the minute and hour fly back hands 5, 6 therefore form a kind of split hand with the hands 2,3 of the normal time display.

Figure 1B:
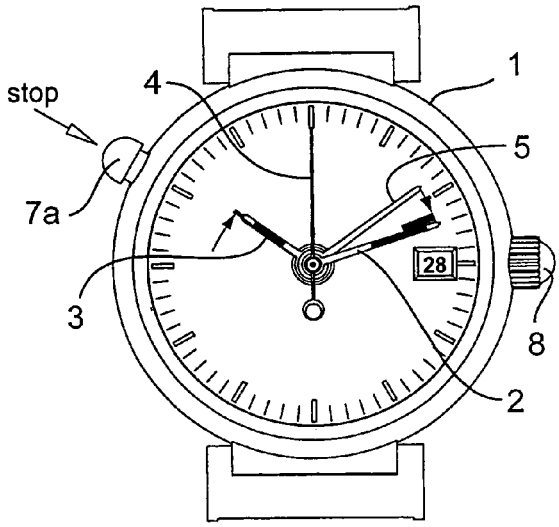

The minute and hour fly back hands 5, 6 represented as white hands, as is shown schematically in FIG. 1*b*, are stopped at their current position by initial actuation of the control element 7, which is represented symbolically with the "stop" arrow, while the minute and hour hands 2, 3 of the analog time display continue to turn. Their motion is indicated symbolically with dashes and arrows.

Figure 1C:
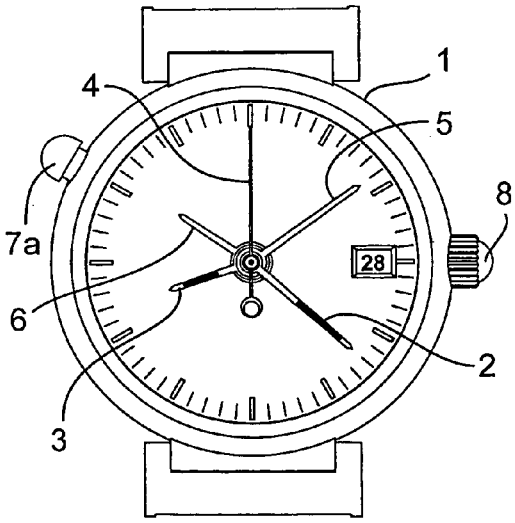

FIG. 1*c* shows the same constellation as in FIG. 1*b* after several hours have passed. It can be clearly recognized that the minute and hour fly back hands 5, 6 set the time of the start of an event in relation to the current time which is indicated by the minute and hour hands 2,3 of the normal time display. The relationship between these two times and the corresponding time difference can be read here in a single display as well as, in particular, the corresponding absolute times.

Figure 1D:
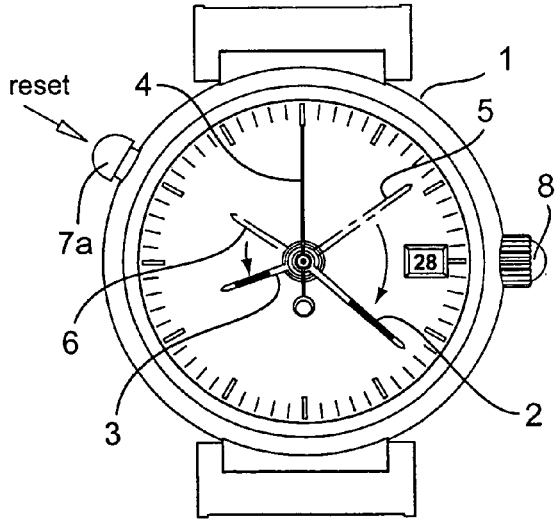

As is shown schematically in FIG. 1*d*, the stopped minute and hour fly back hands 5, 6 can finally be shifted again at any time by another actuation of the control element 7 congruently under the minute and hour hands of the normal time display in order to end measurement of the time difference since the start of the event. This step is represented symbolically with the "reset" arrow; the stop position of the hands is symbolically identified by the dot-dash lines and the direction of motion by arrows.

Figure 2A:
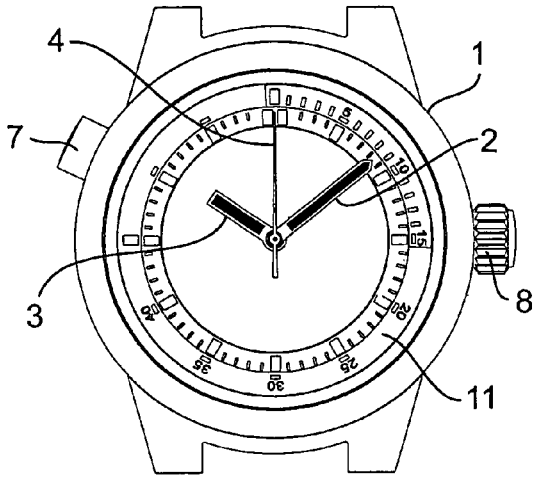
FIG. 2*a* to 2*b* show schematic views of a second embodiment of such a watch.
Figure 2B:
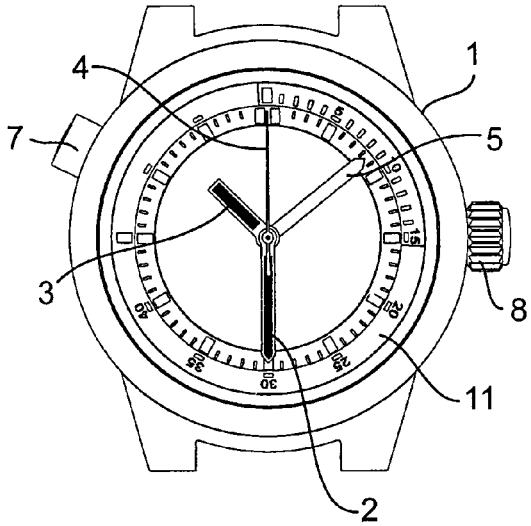

FIGS. 2*a* and 2*b* show a watch with the same functions as described above, but in an embodiment with only one minute fly back hand mechanism, i.e. without the hour fly back hand 6. The views correspond to FIGS. 1*a* and 1*c*, the entire operating sequence being analogous to what was described above.

Furthermore it should be noted that the minute and hour fly back hands 5, 6 in the watch 1 according to the invention in the unstopped state always turn congruently and synchronously with the minute and hour hand 2, 3 of the normal time display. This is likewise the case when the hands 2, 3 of the normal time display are set.

In the stopped state the minute and hour fly back hands 5, 6 do not turn when the hands 2, 3 are being set.

Figure 3:
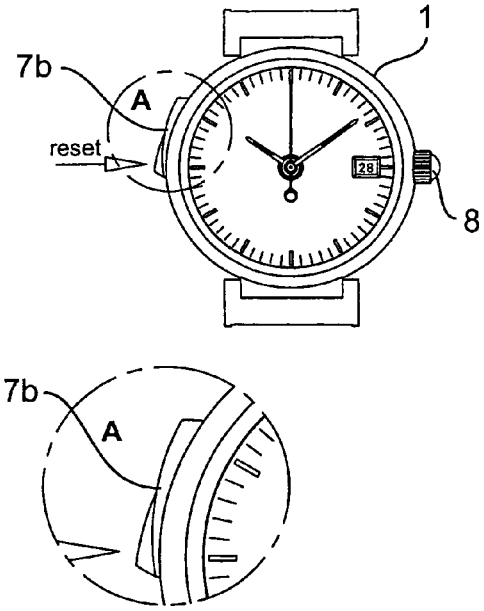
FIG. 3 represents another embodiment of a watch according to the invention in which a rocking commutator has been chosen as the control element of the fly back hand mechanism.
Figure 4:
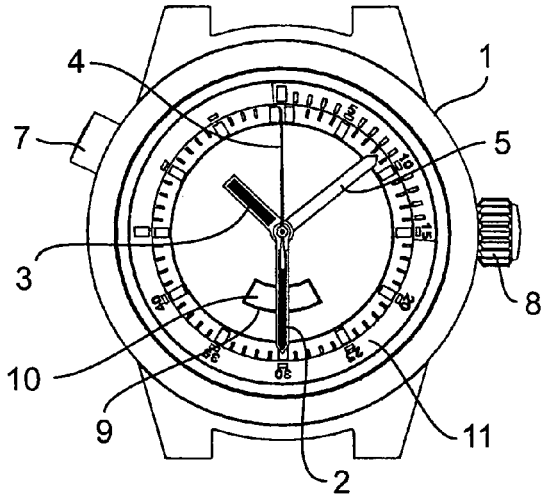
FIG. 4 shows one embodiment of this watch which in addition has a window for status display and a ring with a scale.

Expansions and version of this watch are shown in FIGS. 3 and 4.

In FIG. 3, instead of a push-piece, a rocking commutator 7*b* is mounted on the watch 1 as control element 7 and the operating mode can be read on its position. If the rocking commutator 7*b* is pressed into the lower position, the watch 1 is in the "reset" operating mode, the normal mode, i.e. the minute and hour fly back hands 5,6 turn congruently and synchronously with the hands 2,3 of the time display. If the rocking commutator 7*b* is pressed into the upper position, the watch 1 is in the "timer" operating mode, the timer mode, i.e. the minute and hour fly back hands 5,6 are stopped while the other hands 2, 3 continue to turn. This embodiment has the advantage that the operating mode of the watch 1 is displayed directly by the position of the control element.

The operating mode of the watch 1, as is shown in FIG. 4, can also be displayed using a disk 10 which is visible through a window 9 in the dial of the watch 1 and which has the same task as the rocking commutator 7*b* of FIG. 3. In this case, by actuating the push-piece 7*a* or the rocking commutator 7*b*, the disk 10 is turned so that a sector of the disk 10 corresponding to the current operating mode becomes visible through the window 9 at a time. The disk 10 is made accordingly for this purpose, depending on the angle of rotation which is caused by actuating the control element and which can be chosen repeatedly, and on the good legibility of this display.

The display of the operating mode is useful insofar as for example in certain applications of the watch 1, such as for example within the framework of diving, a status display is recommended for safety reasons.

The watch 1 shown in FIG. 4 moreover has a rotary ring 11 which is arranged coaxially to the axis of the hands of the analog time display and which can be implemented either as an internal or external ring. In the case of an external ring it can be manually turned, in the former case of an internal ring the watch 1 has a conventional device which can be integrated for example in the control element 7 or in the crown 8 in order to execute rotation of the ring. The ring 11 has a scale which preferably has divisions into ranges of 10, 5 and 1 minute with the corresponding inscriptions, which can be configured in various manners, and can moreover have a marking, for example in the form of an arrowhead or a for example fluorescent point. The ring 11 is useful for example in order to directly read the duration of an event by turning the zero of the scale of the ring to the time of the start of the event, or to stipulate a desired time for the end of the event and to display this by means of the marking of the ring 11 explicitly on the watch 1.

The applications of such a watch can be found in the most varied areas and especially in everyday use.

A watch 1 with a minute and hour fly back hand mechanism according to the present invention is suited for easily reading the time which has passed since the beginning of a certain event. This is because by means of a control element 7, such as a push-piece 7*a* or *a* rocking commutator 7*b* on the case, the time displayed by the minute and hour fly back hands 5, 6 is stopped at the instant of the start of the event, while the minute and hour hands 2, 3 of the normal time display continue to turn.

Thus the wearer is reminded when for example a device has been turned on, when a job was begun, when a trip had begun or when a break becomes necessary, etc.

In particular, such a watch 1 can be used as an alternative to a classical chronograph for similar purposes as this one or in dives, for example during the decompression phase.

The advantages of such a watch 1 with a fly back hand function are among others making available an alternative to a classical chronograph with its auxiliary displays, simple operation, a good capacity to estimate and read the length of a process, and the great range of application of this watch.

In general, a watch according to the invention can thus be characterized mainly by the following features. On the one hand, the watch integrates a minute and/or hour fly back hand mechanism. On the other hand, in addition to the fly back hand mechanism the normal time display of the watch remains unchanged. The minute and/or hour hands of the fly back hand mechanism move in the normal mode of the watch in an overlapping position relative to the hands of the normal time display and in a synchronous manner with these hands, therefore forming a kind of split hand with the latter, while in the timer mode they indicate the time of the start of an event, remaining at their position. Control of stopping and setting back the hands of the fly back hand mechanism takes place by means of a control element such as a push-piece or a rocking commutator. The operating mode can be displayed using this rocking commutator or a disk which is visible through a window. Finally, the watch can have a ring with a scale and/or marking.

Thus the primary objective of the present invention is attained, i.e. to allow normal time indication and measurement of a time difference simultaneously, in a direct mutual relationship, as well as in an effective and simple manner, the normal time display not being adversely affected by the presence of the additional hands when they are not being used.

The fly back hand mechanism which is advantageously used for this purpose is characterized by a reset device which is not arranged coaxially relative to the axis of the motion work, by which the height of the movement is reduced and the modularity of the watch is increased.

The invention claimed is:

1. Watch, with an analog time display which has at least a minute hand and an hour hand, and with a fly back hand mechanism which has at least a minute fly back hand and/or an hour fly back hand located coaxially to the hands of the normal time display, the fly back hand or hands in a normal mode of the watch being moved synchronously with the hands of the normal time display and relative to them in an overlapping position, the fly back hand or hands being adapted to be stopped in a timer mode for marking of any instant of time and to be moved, after expiry of any time interval, for again synchronously running with the hands of the normal time display, again into the overlapping position relative to the latter.

2. Watch as claimed in claim 1, wherein the fly back hand or hands of the watch are located underneath the hands of the normal time display.

3. Watch as claimed in claim 1, wherein the control of the fly back hand mechanism of the watch takes place via a control element which is located on the edge of the case of the watch, initial actuation of the control element causing the stopping of the fly back hand or hands for marking of some instant in time, while further actuation, after expiry of any time interval, causes the shifting of the fly back hand or hands again into the overlapping position relative to the minute and/or hour hand of the normal time display for again synchronous running with them.

4. Watch as claimed in claim 3, wherein the control element is implemented by a push-piece.

5. Watch as claimed in claim 3, wherein the control element is implemented by a rocking commutator with two adjustment positions, the respective adjustment position displaying the current operating mode of the watch, the normal or timer mode.

6. Watch as claimed in claim 1, wherein it has a disk which is visible through a window in the dial of the watch for display of the operating mode of the watch, a sector of the disk corresponding to the current operating mode of the watch being visible through the window at a time.

7. Watch as claimed in claim 1, wherein the watch has a rotary ring which is arranged coaxially to the axis of the hands of the analog time display and which is provided with a scale which preferably has divisions into ranges of 10, 5 and 1 minute with the corresponding inscriptions, and/or a marking.

8. Fly back hand mechanism for integration into a watch with hands for an analog display, which has at least one fly back hand which is arranged coaxially to the axis of the motion work of the watch, wherein the fly back hand or hands in the normal mode of the watch is/are moved synchronously with the hands of the analog display and relative to them in an overlapping position, wherein they can be stopped in a timer mode for marking of any instant and wherein they can be moved, after expiry of any time interval, for again synchronously running with the hands of the analog display, again into the overlapping position relative to them, and wherein at least one actuated coupling of the fly back hand mechanism is located non-coaxially to the axis of its fly back hand or hands.

9. Fly back hand mechanism as claimed in claim 8, wherein the actuated coupling which is located non-coaxially to the axis of the motion work of the watch is implemented by a reset device which is located radially around the motion work.

10. Fly back hand mechanism as claimed in claim 9, wherein the reset device has a heart wheel with a heart which is mounted on it and a reset lever wheel which is located coaxially to it with a lever spring, a lever and a roller or a sliding block.

11. Fly back hand mechanism as claimed in claim 10, wherein at least one reset lever wheel is engaged to a corresponding split hand wheel and a heart wheel is engaged to a corresponding wheel of the motion work, the pipe of the latter bearing the hands of the analog display which correspond to the fly back hand on the split hand pipe of the split hand wheel.

12. Fly back hand mechanism as claimed in claim 9, wherein the mechanism has two fly back hands which are controlled by two corresponding reset devices which are located radially around the motion work.

13. Fly back hand mechanism as claimed in claim 9, wherein the mechanism has two fly back hands which are controlled by one reset device which is located radially around the motion work and a minute wheel which is likewise located radially around the motion work and which ensures transmission of the number of revolutions between the gear trains of the two fly back hands.

14. Fly back hand mechanism as claimed in claim 8, wherein the parts of the fly back hand mechanism which cooperate with the actuated coupling and which bear the fly back hand or hands are arranged coaxially to the axis of the motion work of the watch.

15. Fly back hand mechanism as claimed in claim 8, wherein the parts of the fly back hand mechanism which cooperate with the actuated coupling and which bear the fly back hand or hands comprise at least one split hand pipe which bears the corresponding fly back hand with a split hand wheel which is mounted on it and to which a stop wheel which can be stopped by means of a blocking device is attached.

* * * * *